US007401705B2

(12) United States Patent
Craft

(10) Patent No.: US 7,401,705 B2
(45) Date of Patent: Jul. 22, 2008

(54) ORGANIZER SYSTEM AND VERTICAL UPRIGHT WITH ROLLERS

(75) Inventor: Charles W. Craft, Applecreek, OH (US)

(73) Assignee: Rubbermaid Incorporated, Fairlawn, OH (US)

( * ) Notice: Subject to any disclaimer, the term of this patent is extended or adjusted under 35 U.S.C. 154(b) by 525 days.

(21) Appl. No.: 11/026,847

(22) Filed: Dec. 30, 2004

(65) Prior Publication Data

US 2005/0247651 A1 Nov. 10, 2005

Related U.S. Application Data

(60) Provisional application No. 60/533,587, filed on Dec. 31, 2003.

(51) Int. Cl.
*A47F 5/08* (2006.01)

(52) U.S. Cl. ..... 211/90.01; 211/94.01; 211/113; 211/103

(58) Field of Classification Search ..... 211/90.01, 211/106.01, 122, 119.1, 113, 162, 103, 94.01, 211/94.02, 126.15; 104/93, 89, 91; 248/307, 248/317, 323; 16/94 R, 96 R, 98, 106
See application file for complete search history.

(56) References Cited

U.S. PATENT DOCUMENTS 2,771,196 A * 11/1956 Scheuermann ..... 211/94.02
2,975,949 A * 3/1961 Lutsky ..... 223/91
4,240,353 A * 12/1980 Barth ..... 104/93
4,738,369 A * 4/1988 Desjardins ..... 211/113
5,183,162 A * 2/1993 Ritzenthaler ..... 211/1.57
5,332,108 A * 7/1994 Blass ..... 211/90.02
5,402,979 A * 4/1995 Bellamy ..... 248/318
5,501,345 A * 3/1996 Hilstolsky et al. ..... 211/113
5,957,585 A * 9/1999 Dabrowski ..... 383/12
6,098,815 A * 8/2000 Nesser ..... 211/34
6,471,309 B1 * 10/2002 Turner ..... 312/201
6,540,093 B1 * 4/2003 Shumway ..... 211/90.02
6,719,158 B2 * 4/2004 Goldberg ..... 211/123
6,935,519 B2 * 8/2005 Lawson et al. ..... 211/94.02
7,086,543 B2 * 8/2006 Remmers ..... 211/94.01
7,165,684 B2 * 1/2007 Ferron ..... 211/19
2003/0234231 A1 * 12/2003 Rowe ..... 211/90.02
2005/0145147 A1 * 7/2005 Costa et al. ..... 108/108

* cited by examiner

*Primary Examiner*—Jennifer E. Novosad
(74) *Attorney, Agent, or Firm*—Marshall, Gerstein & Borun LLP

(57) ABSTRACT

An adjustable organizer system has a horizontal top rail with an upward facing top side. At least one vertical upright support has one or more contact surfaces carried on an upper end of the upright support. Each of the contact surfaces has at least a downward facing portion engaged with the top side of the top rail. The upright support is suspended from the top rail such that the one or more contact surfaces can move along the top rail while remaining in contact with the top side to selectively position the at least one vertical upright support laterally along the top rail.

8 Claims, 2 Drawing Sheets

ORGANIZER SYSTEM AND VERTICAL UPRIGHT WITH ROLLERS

BACKGROUND OF THE INVENTION

1. Field of the Disclosure

The present disclosure is generally directed to storage and organizer systems, and more particularly to an adjustable organizer system, a laterally adjustable vertical upright for an organizer system, and a method of adjusting the position of vertical uprights in an organizer system.

2. Description of Related Art

Adjustable shelving systems and other storage and organizer systems are known. A typical organizer system includes a plurality of vertical upright supports or standards secured laterally spaced apart to a surface such as a wall. Brackets are attachable to the standards, which are laterally spaced apart on the surface. The brackets can be placed in each of the standards at about the same height to support a storage shelf. Such organizers systems can include other components that are mountable to the vertical uprights or standards.

Typically, once installed, the shelving hardware such as the vertical upright supports or standards are fixed in position and are not easily moved, if at all movable. One recent development is a horizontal top rail for an organizer system. The vertical standards can snap onto the rail. The uprights have an upper end that can be positioned along the top rail as desired and them snapped or secured in place. If one desires to move the standards laterally, they can be unsnapped from the rail, repositioned, and snapped back onto the rail.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present disclosure describes a number of examples of an adjustable vertical upright support for an organizer system. The present disclosure also describes a method of adjusting a vertical upright support in an organizer system. Also, the present disclosure describes an adjustable organizer system. Each of the method, the system, and the vertical upright supports described herein solves or improves upon one or more of the problems noted above with the prior art organizer systems. As disclosed herein, a vertical upright support is configured to include one or more downward facing contact surfaces at its top end. The upright is suspended from a top rail by engaging the contact surfaces with which the top rail. The upright can be laterally repositioned as desired along the horizontal top rail by simply rolling or sliding the vertical upright support therealong while maintaining contact with the top rail.

Figure 1:
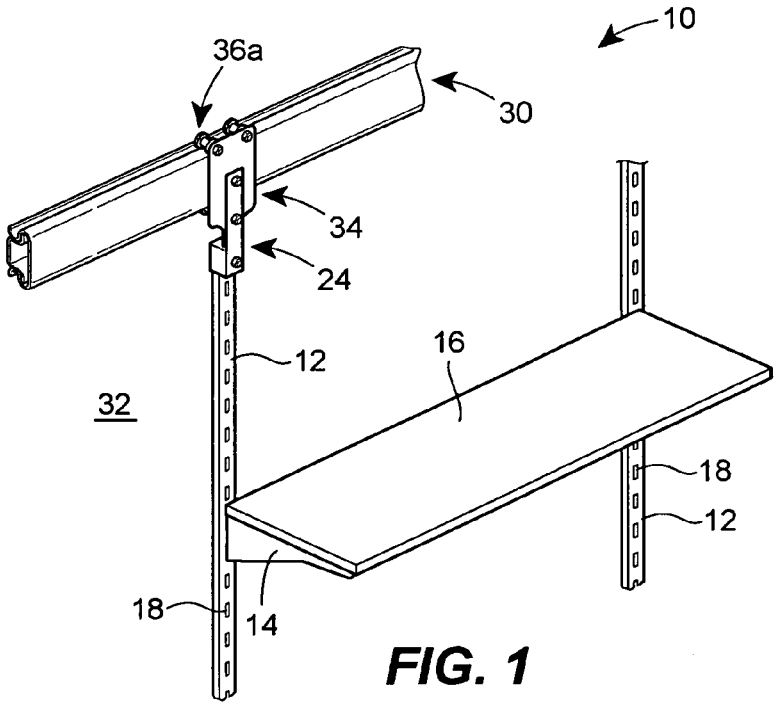
FIG. 1 shows a perspective view of a portion of an organizer system constructed in accordance with the teachings of the present invention.

As shown in FIG. 1, an organizer system 10 can generally include a plurality of mounting standards or vertical upright support 12. Shelf mounting brackets 14 are supported on each of the standards 12 and shelves 16 can then be supported on two or more of the brackets, as is known in the art. In this example, each standard or upright support 12 has an elongate body with a vertical axis when installed, and has a plurality of mounting apertures or openings 18 formed in a front face 20 and spaced apart vertically. Each opening or set of openings 18 provides an optional mounting location for a shelf mounting bracket 14 or other device, as is known in the art.

Figure 2:
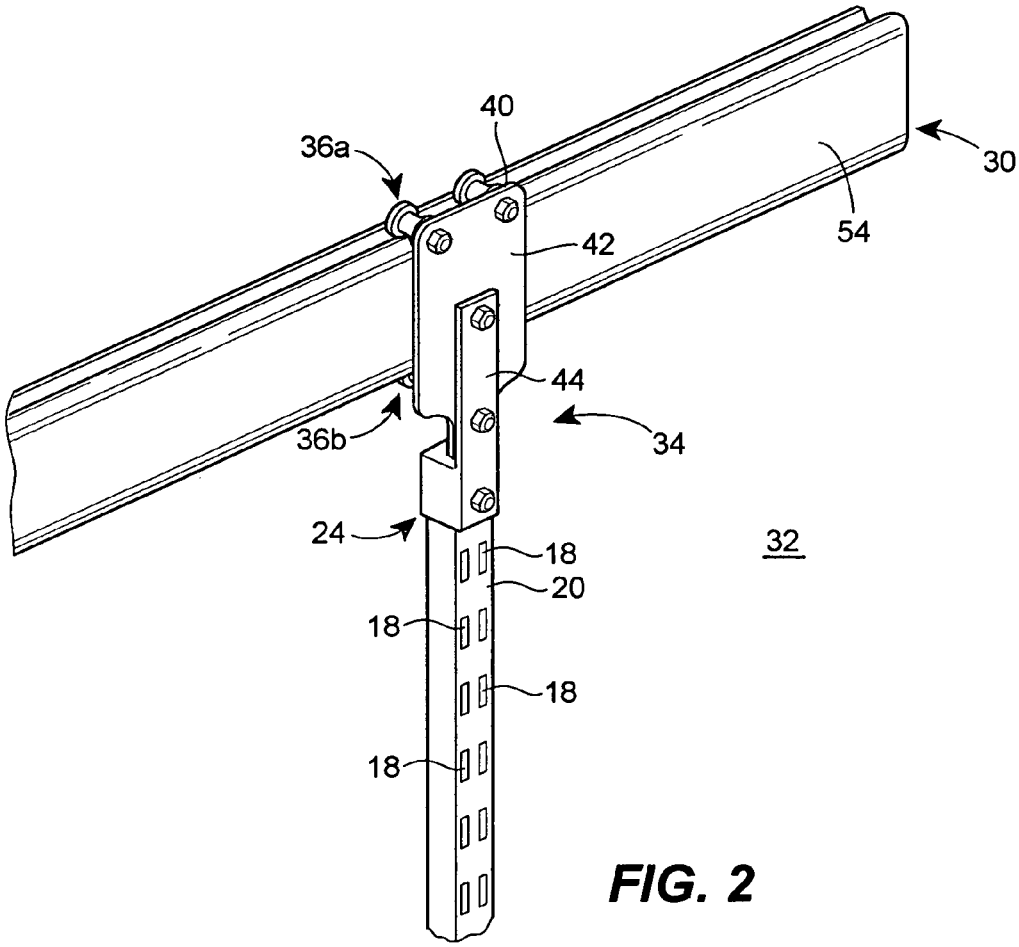
FIG. 2 shows an enlarged view of a part of the system shown in FIG. 1.

Regardless of the particular construction of the standard 12, the top end 24 of the standard 12 is adapted to attach to a horizontal support or top rail 30 mounted to a surface such as a wall 32. In the illustrated example best shown in FIGS. 2 and 3, the top end 24 of each standard 12 includes a coupling or head 34 that carries a plurality of rollers thereon. In this example, the rollers extend rearward from a rear face 38 of the head 34 toward the top rail 30. In this example, a pair of upper rollers **36*a* are provided at or near a top edge 40 of the head 34. These upper rollers 36*a* can roll or spin about an axis that is generally perpendicular to the rear face 38 of the head 34. Thus, the upper rollers 36*a* permit the head 34 and upright 12 to roll laterally along the top rail 30**.

In this example, the head 34 includes a plate section 42 that is positioned forward of the top rail 30 when the standard 12 is installed. The rear surface of the plate section is planar and forms the rear face or plane 38 of the head 34. The head 34 also includes a coupling section 44 that connects the plate section 42 to a top of the standard. The coupling section 44 could be an integral part of the standard, as could the plate section 42. However, in this example, the standard, plate section and coupling section are separate components. The disclosed coupling section 44 has a downward facing socket 46 for receiving the top end of the standard 12 therein. The coupling section 44 also includes a stepped mounting surface 48 that extends upward from the socket 46 and that is offset forward from an axis of the upright 12. In this example, the plate section 42 is borne against and fastened to the mounting surface 48 of the coupling section 44.

Figure 3:
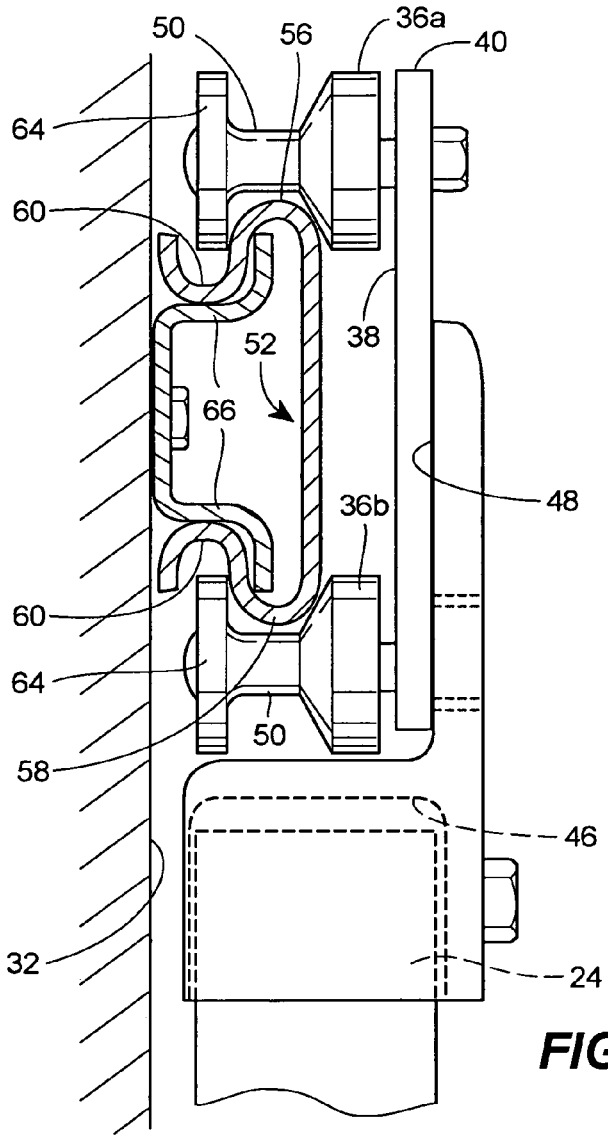
FIG. 3 shows a side view of the top rail and upper part of a vertical upright support of the system shown in FIG. 1.

As shown in FIG. 3, a lower guide roller **36*b* is provided extending rearward from the rear face 38 of the head 34 and also spins or rolls about an axis that is arranged generally perpendicular to the rear face 38. In this example, the rollers 36*a* and 36*b* are each attached to and extend rearward from the plate section 42. Each of the upper and lower rollers 36*a* and 36*b* has a recessed annular groove 50 in its exterior circumferential roller surface. The groove 50 in this example always has a downward facing portion creating a contact surface configured to engage a surface of the top rail 30 as described below. As will be evident to those having ordinary skill in the art upon review of this disclosure, the contact surface between the top rail and the head can take on any number of configurations and constructions as long as the intended purposes and functions are not, i.e., permitting movement of the standards 12 along the top rail 30** while retaining suspended engagement between the two components.

The top rail 30 in this example is best viewed in FIG. 3 from the side. The top rail 30 has a rail body 52, which is somewhat hollow having a forward surface 54 spaced outward from the wall 32 to which the rail is attach. The rail body 52 also has a top side or edge 56 and a bottom side or edge 58, each of which extend rearward from upper and lower edges, respectively, of the forward surface toward the wall 32.

In this example, the top side 56 is a surface that is curved downwardly or concavely inward into the hollow region of the rail body 52. Thus, the top side 56 joins to the forward surface 54 along the top edge of the rail body 52 and curves upward to form a support track 60 that projects upward along the length of the top rail 30. Similarly, the bottom side 58 is a surface that is configured to form a concave groove along the bottom side and inward into the hollow region of the rail body 52. The elongate groove creates a guide track 62 in this example that extends the length of the top rail 30.

As will be evident to those having ordinary skill in the art, the construction and shape of the top rail 30, the support and guide tracks 60, 62, the rollers 36*a*, 36*b*, and the roller grooves 50 can vary considerably and yet fall within the spirit and scope of the invention. Further, the materials utilized to fabricate the various components can vary as needed. The rollers can be plastic, Nylon, steel, or any desirable material. The standards and rail can be aluminum, steel, plastic, or other suitable materials as well. The processes used to fabricate these various components can also vary as needed.

The rollers 36*a* and 36*b* as defined herein can also vary considerably and yet fall within the spirit and scope of the present invention. In one example, the rollers can simply be wheels that freely rotate on independent axles. The entire width or depth of the wheels can be configured to ride within a groove or recessed track on the top rail. Also, an inverse construction to that disclosed can be utilized without department from the spirit and scope of the present invention. In other words, the wheel can have a larger diameter annulus portion that rides in a groove provided in the top side of the top rail. In another example, the rollers can merely be cylindrical stationary devices that glide or slide along the top rail, but do not rotate about their own axis. Thus, the top rails 30 can be laterally positioned simply by sliding and not rolling their contact surfaces along the rail. In yet another example, the contact surfaces need not be circumferential surfaces, but only downward facing surfaces positioned to slide along the top rail.

In this example, a pair of upper support wheels 36*a* are shown. More than two or only a single support roller, slide, wheel, glider, or contact surface can be utilized without departing from the spirit and scope of the present invention. Additionally, only a single lower guide roller 36*b* is depicted in the disclosed example. Even a simple finger or tab can be provided to act as a guide or retainer. Again, however, two or more or the guide rollers or wheels, gliders, slides, or other such guide contact surface can be provided to assist in guiding the standards 12 along the top rail while retaining the standards 12 in a generally vertical orientation. Also, no guide roller need be provided. In a further example, the geometry of the head, standard, and contact surfaces can be such that the standard will naturally rotate or tip inward toward the wall.

In the disclosed example, each of the rollers 36*a*, 36*b* has a larger diameter knob portion 64 positioned at the distal end of each roller outward of the groove 50. The knob portion 64 of the support rollers 36*a* rests in the downwardly recessed portion of the top side 56 rearward of the track 60 and below the level of the track. Similarly, a knob portion 64 of the roller 36*b* bears against or adjacent the upwardly recessed point of the bottom side 58 spaced rearwardly of the guide track 62 at the bottom edge of the bottom side. As shown in FIG. 3, when installed, the gap between the knob portion 64 of the upper support rollers 36*a* and lower guide roller 36*b* is smaller than the height of the top rail 30 retain the upright 12 attached to the top rail. This gap defines an installation access or region into which the top rail 30 is received. The top rail 30 can not be removed forwardly away from the wall 32, but instead is moved laterally over the end of the top rail 30 to be removed, when desired.

The disclosed example does not require any particular means for mounting the top rail 30 to the wall 32. Conventional fasteners can be used directly through the forward surface 54 in order to install the top rail 30 on the wall 32. Alternatively, mounting flanges or tabs can be provided extending from any portion of the top rail, as desired that bear against the wall 32 and fasteners can be received through the flanges. In another alternative, mounting clips or a mounting sub-rail 66 can first be mounted to a wall 32 and then the top rail 30 can be mounted to those clips or sub-rail. In one example, the clips or sub-rail 66 can be designed to fit within and engage the hollow interior of the rail body 52 to hang and/or retain the top rail 30 mounted to the wall 32, as shown in FIG. 3.

In this example, the head, standard, and roller components are attached to one another by conventional fasteners. The rollers 36*a*, 36*b* are attached utilizing nuts and bolts and a shaft part of the bolts provides an axle on which the rollers are mounted and about which they can rotate. The intent is for the standard to be laterally adjustable simply by sliding or rolling it along the rail to its desired location. If the rollers are intended to rotate about their own axis, they can include metal or plastic bearings if desired. Virtually any mounting arrangement for the rollers 36 can be utilized without departing from the spirit and scope of the present invention. Similarly, any suitable mounting method or structure can be utilized for alternative contact surfaces such as wheels, gliders, or slides. Raised contact surfaces can also be used that are integral part of the head 34. The standards 12 can be, if desired, secured to the wall 32 for further stability, once installed on a top rail 30. The rollers 36*a*, 36*b* can also be configured such that they can either snap directly forwardly onto the top rail 30 or telescope over an exposed end of the rail as described above.

Figure 4:
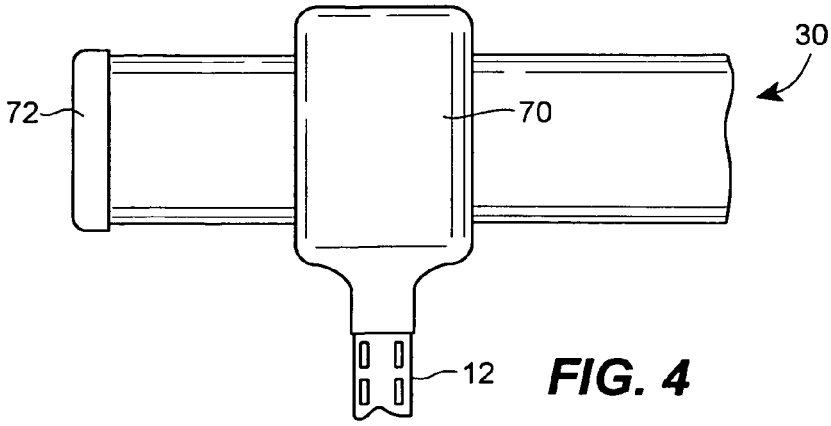
FIG. 4 shows a front view of the organizer system portion of FIG. 1 with a cover received over the upper part of the vertical upright support and a cover over the ends of the top rail.

As shown in FIG. 4, the head 34 can include a decorative cover 70 that hides the head components and provides a desired aesthetic appearance, shape, color, and the like. The cover 70 can be fastened, snapped onto, or otherwise secured to the head 34 as desired. The top rail 30, once the standards 12 are installed over the rail ends, or otherwise snapped onto the rail, can be capped with similar decorative covers 72, as desired.

The standards 12 can be used or adapted to mount and suspend virtually any other type of storage device, such as baskets, bags, hooks, pegs, or the like from the top rail. Only shelves are shown in FIG. 1.

The head 34 is disclosed as having a particular configuration herein. As will be evident to those having ordinary skill in the art, the configuration and construction of the head 34 can vary considerably and yet fall within the spirit and scope of the present invention. Additionally, the top end of the vertical uprights or standards 12 can vary in shape and configuration to assist in providing the desired alignment and coordination between the position of the rollers 36*a*, 36*b* the wall 32, and the top rail 30. In this example, the coupling section 44 of the head 34 provides an offset so that the rollers 36*a*, 36*b* will align with the tracks 60 and 62, and so that the standards 12 will still lie against the wall 32. Different configurations and constructions are certainly possible. For example, the rollers 36*a*, 36*b* can extend directly rearward beyond a plane of the top end 24 of the standards 12. A step can be provided in the body of the standard near to the top end so that the remainder of the upright rests against the wall 32.

In another alternative example, the head 34 can incorporate integral glider or slide surfaces facing downward within a C-shaped (in side view) head. The position of the slide surfaces can be such that the standards 12 will lie directly against the wall 32 below the top rail and the head. In such an example, the rollers are replaced by the glide surfaces, integral or added to the head, to illustrate one of several possible examples of alternatives to the rollers.

Although certain organizer systems, uprights, and methods have been disclosed and described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An adjustable organizer system comprising:

a horizontally oriented top rail having a rail body including an upward facing top side, said upward facing top side, together with an upper elongate outer edge, defining an upwardly-open support track, the upper elongate outer edge extending rearward of a forward surface of the rail body, and a downward facing bottom side, said downward facing bottom side, together with a lower elongate outer edge, defining a downwardly-open guide track, the lower elongate outer edge extending rearward of the forward surface of the rail body, and the rail body being secured to a mounting sub-rail extending substantially the length of the rail body, the mounting sub-rail received in a cavity within the rail body and including an elongate upwardly-extending lip received in a downwardly-open channel between the upwardly-open support track and a rear surface opposite the forward surface of the rail body, and an elongate downwardly-extending lip received in an upwardly-open channel between the downwardly-open guide track and the rear surface opposite the forward surface of the rail body;

at least one vertically oriented upright support having a plurality of spaced openings along a length thereof to receive an engagement member of a mounting bracket; and one or more contact surfaces carried on a plate section coupled to an upper end of the at least one upright support, each contact surface rotatably mounted to an upper portion of a rear face of the plate section and having at least a downward facing portion engaged with the top side of the rail body such that the upright support is suspended from the horizontal top rail, the one or more contact surfaces movable along the top rail while in contact with the top side of the rail body to selectively position the at least one upright support laterally along a length of the horizontal top rail.

2. An adjustable organizer system according to claim 1, wherein the track is an upward projecting track, wherein each contact surface has a groove in at least the downward facing portion, the groove engaging the track at the top side of the horizontal top rail.

3. An adjustable organizer system according to claim 1, wherein the one or more contact surfaces is a circumferential surface of a cylindrical support roller rotatable about an axis.

4. An adjustable organizer system according to claim 3, further comprising at least a pair of the support rollers spaced laterally apart from one another and extending in a rearward direction from a portion of the upper end of the at least one upright support.

5. An adjustable organizer system according to claim 1, further comprising:

at least a pair of the vertical uprights each having a front surface and a plurality of mounting apertures spaced apart vertically in the front surface;

at least a pair of mounting brackets, one each mounted within selected ones of the mounting apertures in each of the pair vertical uprights; and a shelf extending between and supported by the pair of mounting brackets.

6. An adjustable organizer system according to claim 1, wherein at least one guide surface is rotatably mounted to lower portion of the rear face of the plate section, the at least one guide surface facing upward and positioned to contact the bottom side of the horizontal top rail.

7. An adjustable organizer system according to claim 1, wherein the one or more contact surfaces includes at least a pair of support rollers each having a circumferential surface forming a contact surface, each of the circumferential surfaces defining a groove positioned between axial ends of the respective roller, and further includes at least one guide roller positioned below and spaced from the pair of support rollers, the at least one guide roller including a circumferential guide surface and having a groove position between its ends.

8. An adjustable organizer system according to claim 7, further comprising a knob of each of the support rollers and the guide roller positioned rearward of the respective groove in the rollers, wherein the groove in the support rollers is positioned to receive an upward projective track on the top side of the horizontal top rail, and wherein the groove in the guide roller is positioned to receive a downward projecting track on a bottom side of the horizontal top rail.

* * * * *